US005947065A

United States Patent [19]

Bing et al.

[11] Patent Number: 5,947,065

[45] Date of Patent: Sep. 7, 1999

[54] PISTON WITH COOLING CHANNEL

[75] Inventors: Karlheinz Bing, Remseck; Martin Rühle; Fritz Warth, both of Stuttgart; Heinz Wimmer, Leonberg, all of Germany

[73] Assignee: Mahle GmbH, Stuttgart, Germany

[21] Appl. No.: 09/091,951

[22] PCT Filed: Nov. 12, 1996

[86] PCT No.: PCT/DE96/02172

§ 371 Date: Jun. 26, 1998

§ 102(e) Date: Jun. 26, 1998

[87] PCT Pub. No.: WO97/24520

PCT Pub. Date: Jul. 10, 1997

[30] Foreign Application Priority Data

Dec. 27, 1995 [DE] Germany ..... 195 48 811

[51] Int. Cl.[6] ..... F01P 3/06

[52] U.S. Cl. ..... 123/41.35; 123/193.6

[58] Field of Search ..... 123/41.35, 193.6; 92/144, 176, 186

[56] References Cited

U.S. PATENT DOCUMENTS

| | | | |
|---|---|---|---|
| 2,282,085 | 5/1942 | Nichols et al. . | |
| 4,120,081 | 10/1978 | Rösch et al. | 29/888.045 |
| 4,776,075 | 10/1988 | Kawabata et al. | 29/888.047 |
| 4,907,545 | 3/1990 | Mills . | |
| 5,771,776 | 6/1998 | Itoh | 92/186 |

FOREIGN PATENT DOCUMENTS

| | | | |
|---|---|---|---|
| 1244830 | 9/1989 | France | 123/41.35 |
| 410200 | 11/1922 | Germany . | |
| 1955805 | 5/1971 | Germany . | |
| 3601383 | 7/1987 | Germany . | |
| 3721021C3 | 1/1988 | Germany . | |

OTHER PUBLICATIONS

JP 3–145554A., In Patents Abstracts of Japan M–1158, Sep. 13, 1991, vol. 15, No. 366.

*Primary Examiner*—Henry C. Yuen
*Assistant Examiner*—Hai Huynh
*Attorney, Agent, or Firm*—Collard & Roe, P.C.

[57] ABSTRACT

A light-metal piston has a sheet-metal cooling channel integrally cast in the piston head. In order to improve the heat transfer between the piston material and the cooling channel and to reduce the manufacturing costs of the cooling channel, the channel has a narrow slit, which allows oil to pass, extending along at least part of the channel wall.

7 Claims, 1 Drawing Sheet

PISTON WITH COOLING CHANNEL

Figure 1:
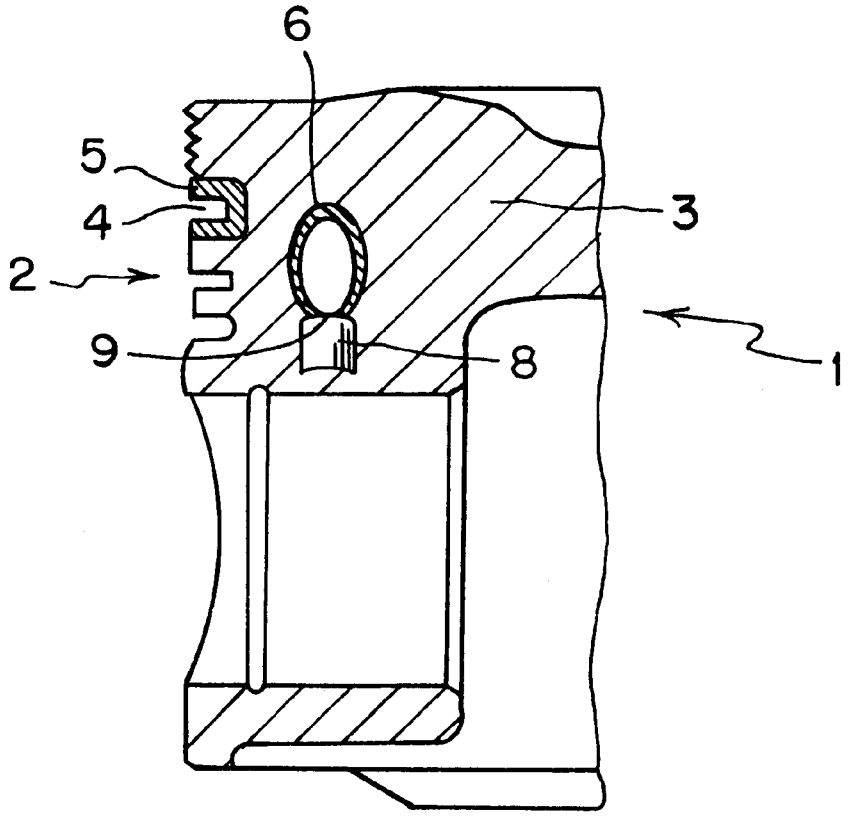

The invention relates to a cast light-metal piston for internal combustion engines, with a cooling channel in the piston head.

A piston of such type is known from DE-PS 37 21 021, where the ring-shaped cooling channel tube consists of an aluminized or alfine-treated material with high thermal conductivity. The butt ends of the tube are joined with each other by a welding process in order to obtain flawless sealing. Due to the aluminizing of the cooling channel tube and the welding of the ends of the tube, however, this represents a more expensive solution.

It is known, furthermore, to position rings or spirals in the casting mold and to pour the material around such elements. The drawback of this solution is that the heat transfer is obstructed. Due to the different coefficients of thermal expansion of steel and aluminum, a slit develops between the cooling channel and the piston at operating temperature, such slit obstructing the flow of heat.

The invention deals with the problem of enhancing the heat transfer between the material of the piston and the cooling channel and of reducing the manufacturing cost of the latter. According to the invention said problem is solved by the features of the characterizing part of patent claim 1.

Advantageous further developments of the invention are the objects of the dependent claims.

As with the cooling channel known from the state of the art, which is made from steel tube, a slit develops at operating temperature between the basic piston material and the sheet metal because of the different coefficients of thermal expansion. However, said slit extending in the cooling channel over at least part of its circumference between the cooling channel and the basic piston material fills with cooling oil. Such oil-filled slit leads to significantly superior heat transfer than a slit filled with air.

Another advantage of the sheet-metal cooling channel as defined by the invention is that such a cooling channel can be manufactured inexpensively by a sheet metal reshaping process, and that the cost for pretreating the cooling channel and for sealing it is omitted. The cooling channel can be shaped in this connection by deep-drawing with subsequent flanging.

The coefficient of thermal expansion of the material of the cooling channel advantageously amounts to between 10 and $17 \cdot 10^{-6}$ 1/K and is thus clearly lower than the one of the basic piston material.

The width of the slit in the cooling channel, such slit extending over at least part of its circumference, is preferably between 0.08 and 0.5 mm; the particularly preferred range is 0.08 to 0.2 mm. In general, the width of the slit has to be dimensioned in such a way that the melt cannot flow through it into the interior of the cooling channel as material is being poured around the latter. The sealing function can be enhanced further in that in addition to a relatively narrow width of the slit, the butt ends of the metal sheet rest one on top of the other, overlapping each other.

Figure 2:
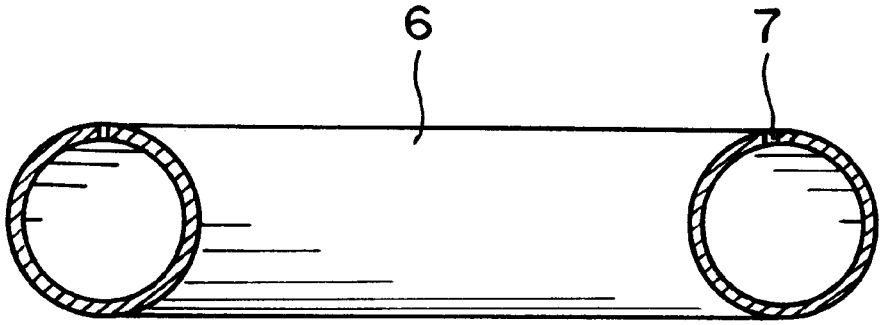

The invention is explained in greater detail in the following with the help of two drawings:

FIG. 1 shows a semisectional view of the piston as defined by the invention; and FIG. 2 shows a cross section through the cooling channel as defined by the invention, with a butt joint.

A light-metal piston 1 made from AlSi-alloy with a piston ring groove arrangement 2 in piston head 3, whose first ring groove 4 is reinforced by a ring carrier 5, has a ring-shaped cooling channel 6 within the zone behind piston ring groove arrangement 2. Along its circumference, said cooling channel has a narrow slit 7 permitting passage of oil. The slit is not visible in the present representation. Said cooling channel 6 is manufactured by a metal sheet reshaping process.

For receiving cooling channel 6 in the course of casting of light-metal piston 1, two holding sleeves 8 (shown displaced in FIG. 1) are employed, said sleeves being supported in the casting die. Said holding sleeves 8 are arranged with respect to the circumference of cooling channel 6 and each connected with the latter via a punched hole 9 in such a way that after light-metal piston 1 has been produced and said holding sleeves 8 have been removed, a feed and discharge channel has been formed for the cooling fluid.

As shown in FIG. 2 by the section through the cooling channel ring, cooling channel 6 has a slit 7 (shown not true to size, but enlarged) on its top side, by which the interior of cooling channel 6 is connected with the environment, and through which cooling oil can flow under operating conditions into the slit between the outer wall of the channel and the basic material of the piston, which significantly improves the heat transfer between the basic material and the cooling channel. The penetration of oil into the slit present between the cooling channel and the basic material is accelerated by the delaying forces acting on the oil in the downward stroke, and the build-up of pressure in the oil occurring as a result within the zone of the slit.

For cost reasons, said slit 7 is advantageously produced by butting the two end of the metal sheet; however, it can be produced also by overlapping the ends of the metal sheet.

In the inoperative condition, the cooling oil present in said slit is then forced back into cooling channel 6 due to cooling of the piston, when the basic material contracts stronger than the material of the cooling channel.

The cross section of the ring channel must not necessarily be circular or oval as shown in FIGS. 1 and 2.

We claim:

1. A cast light-metal piston for internal combustion engines, with a cooling channel made from sheet metal in the piston head, characterized in that the cooling channel (6) has a narrow slit (7) permitting passage of oil, said slit extending over at least part of its circumference.

2. The cast light-metal piston according to claim 1, characterized in that the cooling channel (6) consists of steel sheet or copper sheet.

3. The cast light-metal piston according to claim 2, characterized in that the cooling channel (6) consists of galvanized steel sheet.

4. The cast light-metal piston according to claim 1, characterized in that the narrow slit (7) extends over the total circumference of the cooling channel (6).

5. The cast light-metal piston according to claim 1, characterized in that the slit (7) has a width of from 0.08 to 0.5 mm.

6. The cast light-metal piston according to claim 1, characterized in that the slit (7) is formed by butting the ends of the metal sheet.

7. The cast light-metal piston according to claim 1, characterized in that the thickness of the metal sheet amounts to from 0.1 to 0.8 mm.

* * * * *